United States Patent [19]

Phelps

[11] 4,218,819

[45] Aug. 26, 1980

[54] SPRING LOCKED DISASSEMBLY FOLDING KNIFE

[76] Inventor: Paul S. Phelps, 1306 Woodlawn Dr., Maryville, Tenn. 37801

[21] Appl. No.: 39,959

[22] Filed: May 17, 1979

[51] Int. Cl.[3] ..... B26B 5/00

[52] U.S. Cl. ..... 30/157

[58] Field of Search ..... 30/157, 156, 161

[56] References Cited

U.S. PATENT DOCUMENTS

| | | | |
|---|---|---|---|
| 1,087,342 | 2/1914 | Yerzley | 30/157 |
| 1,182,043 | 5/1916 | Schles | 30/157 |
| 4,161,818 | 7/1979 | Phelps | 30/157 |

*Primary Examiner*—Jimmy C. Peters

*Attorney, Agent, or Firm*—Martin J. Skinner

[57] ABSTRACT

A folding knife is described which may be disassembled without the use of tools for the purpose of cleaning the interior, changing blades or the like. The knife has a pair of side plates each having a slot of nonuniform width near each end that align with corresponding slots in the facing plate. Annularly grooved pins fit in each aligned set of slots. A back spring is positioned between the side plates, and a pivot therethrough engages a cooperative pair of holes in the side plates. One grooved pin passes through a circular opening in the tang of a blade, the pin being the pivot for the blade. A second grooved pin passes through a circular opening in a locking cam unit, the pin being the pivot for the cam. When rotated in one direction the cam unit locks the grooved pins in the slots and tensions the back spring against the blade tang. Rotation in the opposite direction unlocks the pins, removes the spring force, and thereby permits the side plates to be moved apart and disengages all parts for cleaning or replacement.

4 Claims, 6 Drawing Figures

SPRING LOCKED DISASSEMBLY FOLDING KNIFE

BACKGROUND OF THE INVENTION

My invention relates to folding knives, often referred to as pocket knives, and more particularly to knives having means for the disassembly of the knife for cleaning or replacement of parts.

One knife of the prior art designed for disassembly is that described in U.S. Pat. No. 3,061,927 issued Nov. 6, 1962, to O. von Frankenberg und Ludwigsdorf. In that knife, a screw holding the blade is removable after a lever applying pressure to one or more springs is rotated. The internals, i.e., spring and lever, can be then removed; however, the side pieces remain in their spaced relationship due to transverse rivets. Thus, the interior of the case cannot be fully cleaned.

Another prior art knife is that disclosed in my copending patent application "Folding Pocket Knife Having Replaceable Blades". In that knife, a set screw passing through the lock-type back spring is the primary locking element. After removal of the screw and the back spring, rotary unlocking motion of a second spring disengages locking pins permitting even the side plates to be removed. While only one tool is required for the disassembly operation, that tool might not always be available when disassembly is desired.

SUMMARY OF THE INVENTION

In my present invention, I use a rotatable cam member pivotally mounted in the knife handle at the end opposite that having a blade and blade pivot, said cam member engaging one end of a back spring whereby in a locked position the back spring exerts force on the blade tang and in the unlocked position said force is released. Actual locking is augmented by the pivots for the blade and the cam, said pivots having annular grooves which engage in slots of nonuniform width in the knife handle.

BRIEF REFERENCE TO THE FIGURES

SPECIFIC EMBODIMENT

Figure 1:
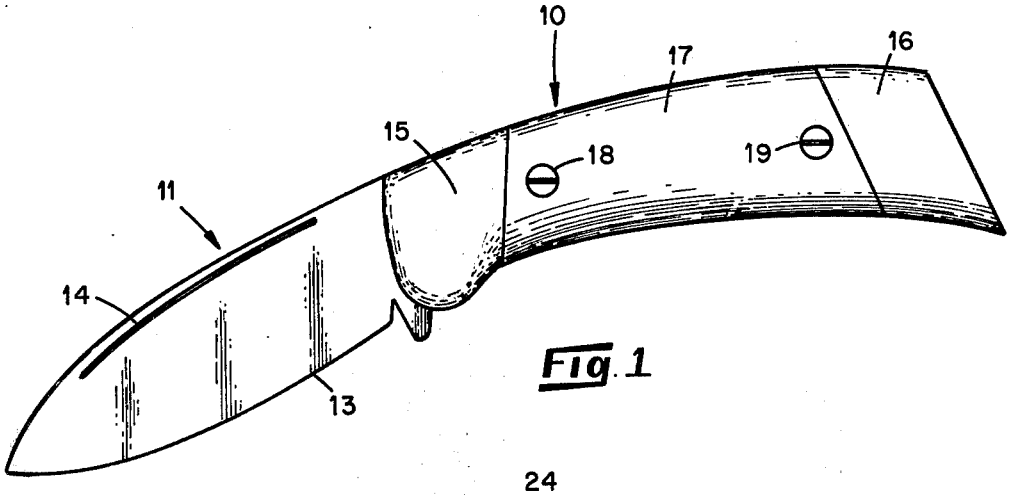
FIG. 1 is an isometric drawing of my improved knife structure with the knife blade in the extended or open position.

Referring now to FIG. 1, my knife comprises a handle unit 10 and a blade 11. The particlar blade shown, known as a finger skinner, has a sharpened cutting edge 13 and an elongated groove 14 to assist in the movement of the blade 11 from within a recess (not shown) in the handle unit 10. A blade of another configuration, e.g., a drop-point skinner, can be substituted as described hereinafter. Other cutting elements may be substituted, also.

The exterior of the handle unit 10 is generally conventional with a forward bolster 15 and rearward bolster 16. Spaced between the two bolsters is a gripping and/or decorative panel 17. Panel 17 is secured to an internal member (not shown) as with screws 18, 19. The bolsters 15, 16 are also secured to the same internal member (see FIG. 3). If desired, the securing means for the panel 17 may enter from the reverse surface.

Figure 2:
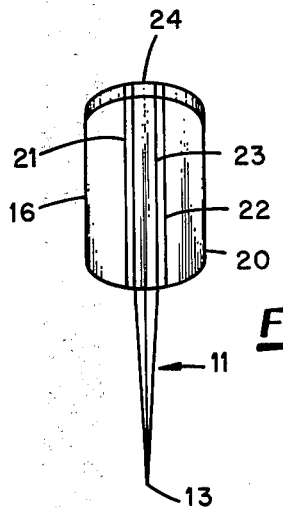
FIG. 2 is a view of my knife from the end opposite the blade.

An end view of my knife, from the end opposite the blade 11, is shown in FIG. 2. It may be seen that a second rearward bolster 20 is a match for bolster 16. These bolsters strengthen the handle unit and protect the aforementioned panel 17 (of FIG. 1). Bolster 16 is attached to an inner handle plate 21, as described above, and bolster 20 is attached to a second inner handle plate 22 that is parallel to plate 21 and a mirror image thereof. At the rearward end of the handle unit 10, plates 21, 22 are maintained at a specified separation distance, to form the recess (not shown) for blade 11, by a locking cam plate 23. In addition, the spacing is maintained by a back spring 24 running substantially the length of the handle unit 10.

Figures 3, 4, 5:
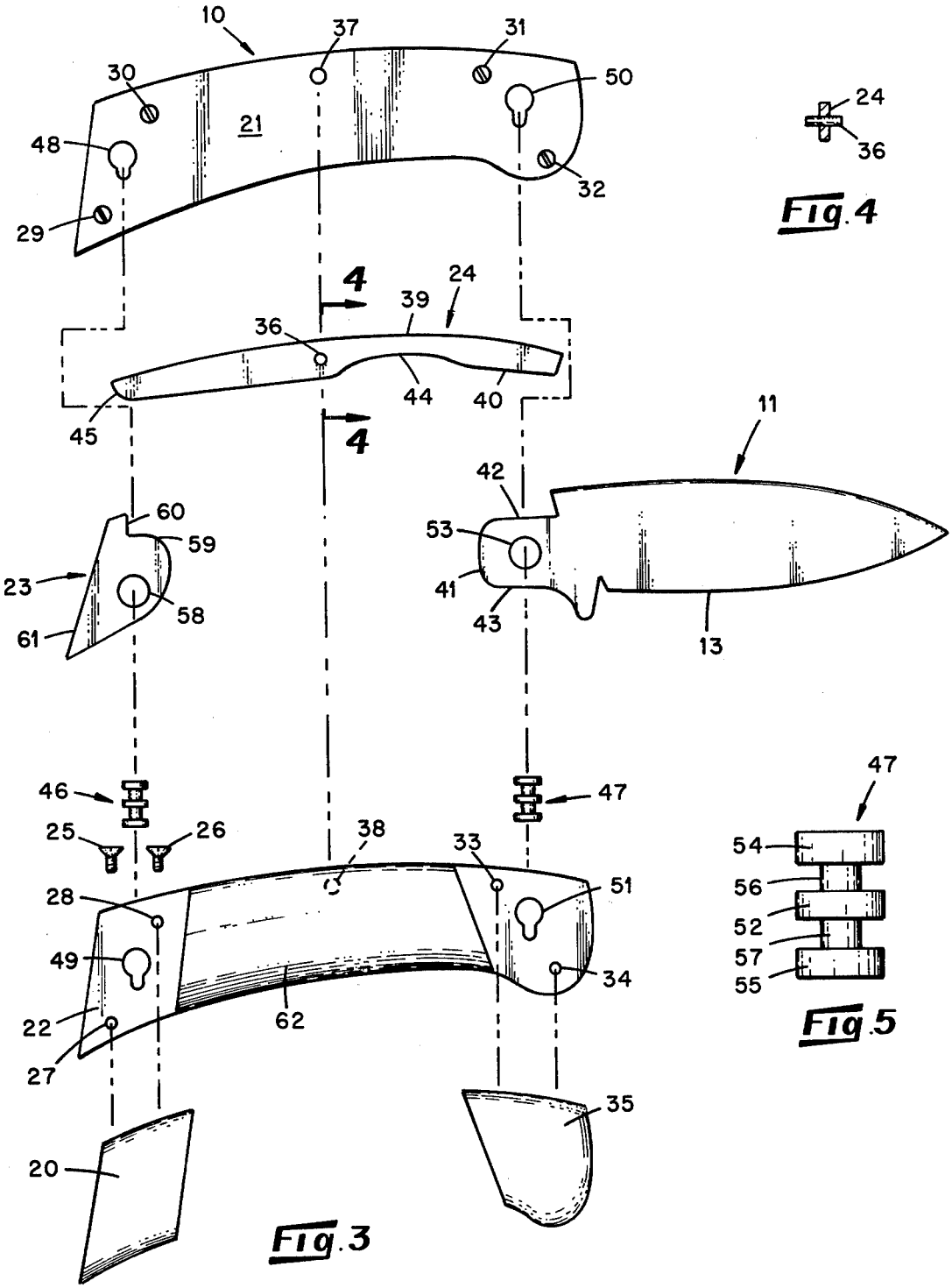
FIG. 3 is an exploded view of my knife showing the parts thereof.
FIG. 4 is a cross sectional view of the knife backspring taken at 4—4 of FIG. 3.
FIG. 5 is an enlarged view of the locking pins of FIG. 3.

FIG. 3 is an exploded view of my knife showing the individual components thereof. It may be seen that rearward bolster 20 is attached to plate 22 as with a pair of flat head machine screws 25, 26 passing through openings 27, 28. Similar screws 29, 30 and 31, 32 hold bolsters 15, 16 (not shown), respectively, to plate 21. In addition, other screws (not shown) passing through holes 33, 34 attach a second forward bolster 35 to plate 22.

Back spring 24 is provided with a cross pin 36 at a generally central location (see also FIG. 4). This pin 36 fits within opening 37 of plate 21 and opening 38 of plate 22 when the knife components are assembled. The top edge 39 of spring 24 is contoured to match that of the upper edges of plates 21, 22 under normal conditions. A forward lower surface 40 of spring 24, when my knife is assembled, bears against a tang 41 of blade 11: against edge 42 when the blade 11 is in an open position; and against edge 43 when the blade is in a closed position. The back spring is reduced in height between pin 36 and edge 40, as at 44, to provide the spring characteristic. Rearward of pin 36 the back spring 24 is of generally uniform height to the rearward cam follower edge 45; thus, serving primarily as a lever over this length.

The locking feature of my knife is principally provided by locking pins 46, 47 in cooperation with plates 21, 22. For example, plate 21 has a keyhole-shaped slot 48 near the rearward end: a corresponding and aligned keyhole-shaped slot 49 is provided in plate 22. (Other shapes of slots having a nonuniform width could be used, e.g., a teardrop-shaped slot.) Similarly, plate 21 has a forward keyhole-shaped slot 50 that matches a corresponding forward keyhole-shaped slot 51 in plate 22. The distance from opening 37 to the center of slot 48 is equal to that from opening 37 to slot 50. This is, therefore, the same as from slot 49 to opening 38 to slot 51 in plate 22. The long dimensions of the slots 48-51 are aligned along a hypothetical circle using openings 37, 38 as a center. The narrow portion of the slots is directed away from the back spring position.

Locking pin 47, which is identical to locking pin 46, is detailed in FIG. 5. This pin has a generally double bobbin configuration. A central cylindrical portion 52 has a diameter that is a slip fit with an opening 53 in the blade tang 41 and with the larger portion of keyhole-shaped slots 50 and 51. The width of this central portion 52 is substantially equal to the thickness of the tang 41. Two end cylindrical portions 54, 55, having a diameter substantially equal to that of the central portion 52, are separated from the central portion by annular recesses or valleys 56, 57. The diameter of the pin 47 at these valleys is a slip fit with the smaller width portions of keyholeshaped slots 50, 51. The width of these valleys is equal to the thickness of plates 21, 22. These dimensions permit, for example, pin 47 to be moved axially into the larger portion of slot 50 and then to be translated to fit into the smaller width portion. The end portions 54, 55 of pin 47 fit within hollows (not shown) in the rear surfaces of bolsters 15, 35.

The other major portion of the mechanism that permits disassembly is the locking cam plate 23. This cam plate is provided with an opening 58 to receive locking pin 46 that acts as a pivot and a center for cam surface 59 which terminates with a shoulder 60. A substantially straight rearward edge 61 of the plate matches the angle of the rearward edges of handle plates 21, 22. When assembled, cam surface 59 engages the cam follower edge 45 of back spring 24, with the shoulder 60 against the most rearward end of the back spring.

Although keyhole-shaped slots are shown, and may be preferred, other shapes of nonuniform width slots may be utilized in plates 21, 22. For example, an elongated teardrop shape may be used if the wider width accepts the end of pins 46, 47 and the narrower width fits the annular grooves of the pins. As another variation, the slots may be elongated trapezoids or truncated triangles if dimensions are chosen to permit proper engagement with the pins 46, 47 and provide the above-described locking-unlocking arrangement.

Also shown in this figure is a second gripping and/or decorative panel 62 which is attached to handle plate 22 by suitable means, e.g., screws (not shown), as is the case for panel 17 (FIG. 1).

Figure 6:
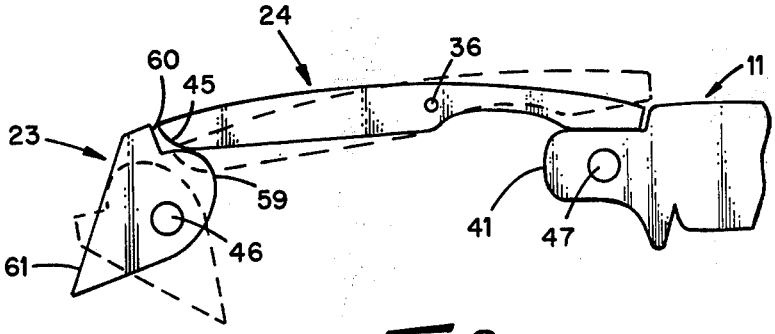
FIG. 6 is a drawing illustrating the relationship of the blade, the back spring and the rotatable cam plate of my knife.

The method of assembly and disassembly of my knife can be understoor by reference to FIG. 6 in combination with FIG. 3. In this FIG. 6, the dashed lines are indicative of positions in an unlocked condition; and the solid lines, in a locked position (the spacing of components is exaggerated to facilitate the understanding). For assembly, locking pin 46 is inserted through the locking cam plate 23 and into slot 48 of plate 21. Locking pin 47 is inserted through blade tang 41 into slot 50 of plate 21. With the locking cam plate 23 in the unlocked (dashed line) position, the back spring 24 is inserted against liner plate 21 with pin 36 inserted into hole 37. Thereafter, liner plate 22 is placed upon the locking cam plate 23, the back spring 24 and the blade tang 41 with locking pins 46, 47 entering, respectively, the larger portions of slots 49, 51. Locking is effected by rotating the locking cam plate 23 in a clockwise direction (in these figures). As rotation progresses, pressure of cam surface 59 against the cam follower edge 45 of back spring 24: (a) moves locking pin 46 into the smaller width portions of slots 48, 49; (b) pivots back spring 24 about pin 36 whereby forward edge 40 engages tang 41 causing pin 47 to move into the smaller width portions of slots 50, 51; and (c) produces a slight bending of back spring 24 at the reduced height portion 44 to maintain tight contact between all of the locking components.

Disassembly involves the reverse steps. Locking cam plate 23 is rotated counterclockwise by using pressure against the lower portion of rearward edge 61. This disengages contact between the locking cam plate 23 and the cam follower edge 45 of back spring 24. Back spring 24 is also loosened with respect to the blade tang 41. A slight twisting motion of liner plate 21 with respect to liner plate 21, pivoting around pin 36, brings about disengagement of one or more of locking pins 46, 47 from the slots in liner plates 21, 22. The components are then easily separated to permit cleaning, changing of types of blades, or replacement of damaged pieces.

Although not shown in any of the figures, my design is applicable to folding knives having more than one blade. In such an embodiment it may be desirable to utilize a separate back spring for each blade, with a pivot pin common to all springs. A single locking cam plate of thickness equal to the total thicknesses of the back springs, and blade tangs, would be acceptable. The locking pins, instead of a single central enlarged diameter, would have an equivalent part corresponding to the positions of the various blade tangs.

It will be apparent from the foregoing that I have developed a folding knife that may be disassembled without the use of any tools. This will be of particular value to the sportsman who may wish to completely clean the knife after processing fish or game. It will also be of aid to the hobbyist who may wish to change blades. Since broken blades and back springs heretofore have necessitated discarding the entire knife, now replacement parts may be installed using my present knife design.

I claim:

1. First and second elongated handle plates for parallel, spaced apart relationship, said plates having a forward end, a rearward end and a back edge, each plate being provided with a first variable width slot near said forward end and a second variable width slot near said rearward end, and a pivot-receiving opening equidistant between said forward and rearward slots;

an elongated back spring interposed between said first and second handle plates at said back edge, said back spring having a forward end and a rearward end, and being provided with a transverse hole midway between said forward and rearward ends;

a pivot passing through said transverse hole in said back spring for engagement with said pivot-receiving openings of said handle plates;

a cutting element interposed between said first and second handle plates at their forward end, said cutting element having a tang provided with a transverse pivot aperture, said tang being in contact with said forward end of said back spring;

a first cylindrical locking pivot pin penetrating said tang pivot aperture and extending from opposite surfaces of said tang, said extending portions of said pin being provided with annular grooves for releasible engagement with said forward variable-width slots in said handle plates, said cutting element being rotatable about said first locking pin;

a rotatable cam plate interposed between said first and second handle plates at their rearward end, said cam plate being provided with a transverse pivot aperture, and having a cam surface with respect to said pivot aperture on a forward edge in contact with said rearward end of the back spring; and a second cylindrical locking pivot pin penetrating said cam plate aperture and extending from opposite surfaces of said cam plate, said extending portions of said second pin being provided with annular grooves for releasible engagement with said rearward variable width slots in said handle plates, said cam plate being rotatable about said second locking pin to effect an increase or decrease in contact force between said cam surface and said back spring, and between said back spring and said tang of said cutting element.

2. The knife of claim 1 wherein the slots in said handle plates are a keyhole shape, and the narrower portion of the slots are directed away from said back edge.

3. The knife of claim 1 further comprising a forward and a rearward bolster on each of said handle plates on a side opposite said back spring, and a decorative panel disposed between said forward and rearward bolster attached to each of said handle plates.

4. The knife of claim 1 wherein said cutting element is a knife blade.

* * * * *